US008987576B1

(12) United States Patent
Baxter

(10) Patent No.: US 8,987,576 B1
(45) Date of Patent: Mar. 24, 2015

(54) ELECTRONIC MUSICAL INSTRUMENT

(71) Applicant: Keith M Baxter, Brookfield, WI (US)

(72) Inventor: Keith M Baxter, Brookfield, WI (US)

(73) Assignee: Keith M. Baxter, Brookfield, WI (US)

( * ) Notice: Subject to any disclaimer, the term of this patent is extended or adjusted under 35 U.S.C. 154(b) by 108 days.

(21) Appl. No.: 13/735,521

(22) Filed: Jan. 7, 2013

(51) Int. Cl.
*G10H 3/00* (2006.01)
*G10H 1/32* (2006.01)

(52) U.S. Cl.
USPC ..... 84/723; 84/743

(58) Field of Classification Search
USPC ..... 84/723, 730, 733, 743
See application file for complete search history.

(56) References Cited

U.S. PATENT DOCUMENTS

| | | | | |
|---|---|---|---|---|
| 4,651,613 | A * | 3/1987 | Harrison | 84/95.2 |
| 4,836,075 | A * | 6/1989 | Armstrong | 84/606 |
| 6,005,181 | A * | 12/1999 | Adams et al. | 84/734 |
| 6,366,758 | B1 * | 4/2002 | Dunn et al. | 434/319 |
| 7,687,702 | B2 * | 3/2010 | Chu | 84/476 |
| 8,426,719 | B2 * | 4/2013 | Shim | 84/743 |
| 8,525,014 | B1 * | 9/2013 | Scharfeld | 84/662 |
| 2011/0239848 | A1 * | 10/2011 | Beck | 84/726 |
| 2012/0297961 | A1 * | 11/2012 | Shim | 84/645 |
| 2012/0297962 | A1 * | 11/2012 | O'Donnell et al. | 84/645 |

* cited by examiner

*Primary Examiner* — Jeffrey Donels
(74) *Attorney, Agent, or Firm* — Boyle Fredrickson, S.C.

(57) ABSTRACT

An automatic tuning system for pendulum clocks provides for a separable magnet and ferromagnetic attractor, one positioned on the pendulum and one positioned off of the pendulum and adjustable to change the separation between the two. The magnetic attraction between these elements serves to simulate a changing gravitational force fundamentally affecting pendulum period.

11 Claims, 12 Drawing Sheets

ELECTRONIC MUSICAL INSTRUMENT

CROSS REFERENCE TO RELATED APPLICATION

This application claims the benefit of U.S. provisional application 61/583,382 filed Jan. 5, 2012 and hereby incorporated by reference in its entirety.

STATEMENT REGARDING FEDERALLY SPONSORED RESEARCH OR DEVELOPMENT

I. Crayon Coloring System

The first present invention relates to an artistic kit and in particular to a system for providing improved artistic renderings in media such as wax crayons.

BACKGROUND OF THE INVENTION

Wax crayons provide an artistic medium that is relatively inexpensive, non-toxic, clean to use, and readily available. These features make crayons particularly attractive for use with children in creative endeavors and in early practice of motor skills.

Nevertheless, wax crayons have some significant drawbacks. It is difficult to create an even, highly saturated field of color with most crayons. Smooth papers do not receive the wax of the crayon effectively and attempts to lay down additional layers of crayon may be defeated by the preceding layer of wax which provide a lubricating layer resisting further abrasion of the crayon tip. Too much pressure on the crayon can cause a "plowing" of the previous layer resulting in small specks of dark color that can become detached and can undesirably spread over other areas of the drawing. Rough papers which provide better "tooth" to abrade the wax crayon tip for the deposition of color, produce a mottled color field with significant uncolored area.

For these reasons, children can become dissatisfied with crayons at an early age before they have access to other artistic media, potentially curtailing their artistic explorations.

SUMMARY OF THE INVENTION

The present invention provides an improved form of coloring book or similar coloring materials that provide increased color saturation, uniformity, and gradation when using wax crayons. In a simplest embodiment, the invention includes a semitransparent top sheet and corresponding opaque bottom sheet providing each printed with a desired outline. Both sheets may be colored with wax crayons and then superimposed to align the outlines. In this way, the coloring of each layer is reinforced increasing saturation of the colors when similar colors are used and providing novel color combinations when different colors are used. The top sheet also acts as a diffusing layer allowing more uniform colors and smoother shading effects to be implemented.

DETAILED DESCRIPTION OF THE PREFERRED EMBODIMENT

Figure 1:
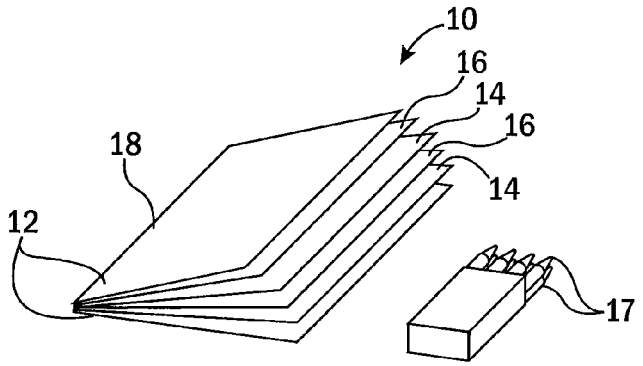
FIG. 1 is a perspective view of a coloring book implementing the present invention having alternate opaque and semitransparent sheets.

Referring now to FIG. 1, a coloring book 10 of the present invention may provide for a pair of covers 12 holding a series of alternating semitransparent paper sheets 14 and opaque paper sheets 16.

The semitransparent sheets 14 may, for example, be a fiber-based vellum material providing the ability to read black twelve-point text through the sheet when the text is one-sixteenth of an inch away from that surface of the sheet. The opaque paper sheets 16 may be any standard paper material but is preferably a bleached fiber white paper providing opacifiers for high opacity and reflectance. Standard copy paper may be used in this capacity. The left edges of each sheet 14 and 16 may be bound by the spine 18 between the covers 12 in a registered fashion as will be understood from the description below. The spine 18 may bind the pages with glue, stitching or the like.

Figure 2:
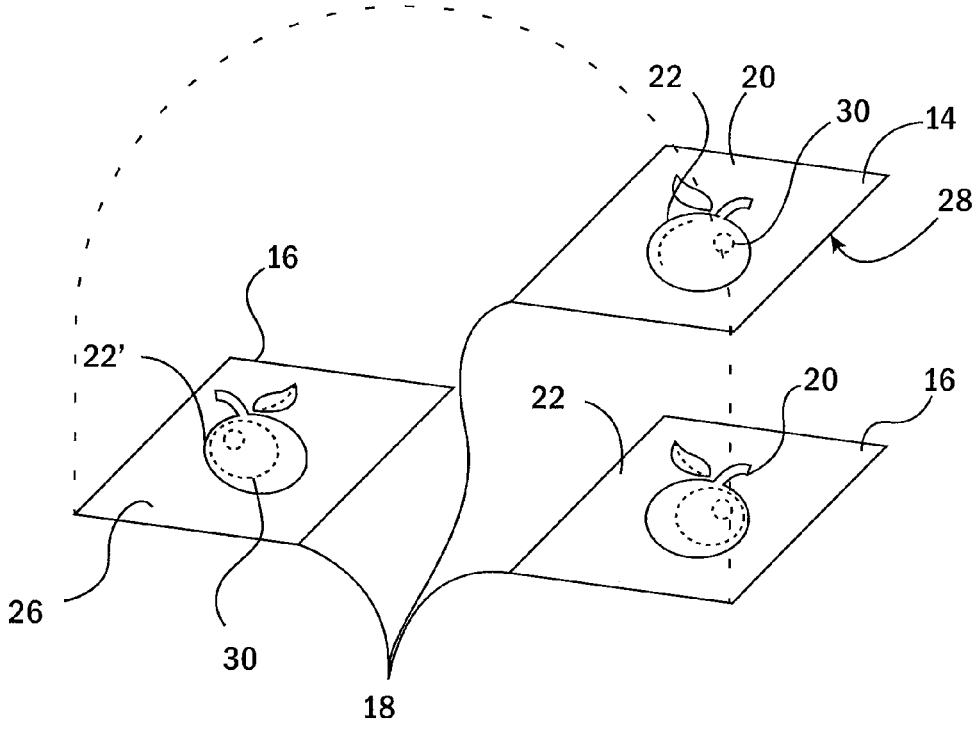
FIG. 2 is an exploded diagram of three successive pages of the coloring book showing an ability to provide coloring guides for three different coloring patterns.

The coloring book 10 may be provided in conjunction with a box of wax crayons 17 having enumerated or labeled colors that may relate to and be keyed to the coloring patterns to be described herein Referring now to FIG. 2, a front surface 20 of the semitransparent sheet 14 may have a printed outline 22 comprised of black ink in the form of actual lines and/or stippling patterns. The semitransparent sheet 14 may fit on top of a lower opaque sheets 16 having on its front surface 20 a corresponding printed outline 22 so that the two outlines 22 will align with each other when placed one on top of the other as held by the spine 18. The printed outlines 22 on the semitransparent sheet 14 and the opaque sheet 16 need not be identical. Other colors of ink may be used for the printed outlines 22 and their thickness may be different, for example, to minimize or accentuate the printed outline 22 on the semitransparent sheet 14.

The transparent sheet 14 may be bound so that its front surface 20 may be placed against a rear surface 26 of an upper opaque sheets 16' which may also have an outline 22' corresponding to the mirror image of outline 22 so that the two may also be aligned in registration in this inverted form. Each of the outlines 22 may also include coloring guidelines 30 showing boundaries between different colors and shades rather than the edge of an object (e.g., foreground versus background) which coloring guidelines 30 may be the same or may differ from other corresponding coloring guidelines 30 as will be discussed below. Generally the coloring guidelines 30 may be thinner or lighter than the outlines 22.

Figure 3:
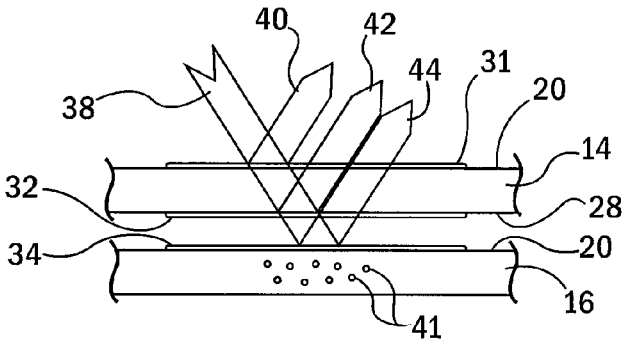
FIG. 3 is a simplified cross-sectional view through the opaque and semitransparent sheets showing multiple reflections and transmissions that improve the saturation of reflected light.

Referring now to FIG. 3, in use, the front surface 20 of the semitransparent sheet 14 may be colored to deposit a colored wax layer 31 on its front surface 20. The wax layer 31 may be applied with reference to the outlines 22 (shown in FIG. 2) on either the sheets 14 and 16 and/or the coloring guidelines 30. In addition, a rear surface 28 of the upper sheet may also be colored to provide a wax layer 32. This wax layer 32 may be guided by the outline 22' or the coloring guidelines 30 on the rear surface 26 of the upper sheet 16'. Finally, front surface 20 of the lower sheet 16 may also be colored to provide a wax layer 34 guided by the outline 22 on the front surface 20 of the lower sheet 16 and/or coloring guidelines 30.

Ambient light 38 passing down on the top of the transparent sheet 14 when aligned and abutting the upper surface of the opaque sheets 16 will provide a first reflected component 40 being light reflected off of the upper wax layer 31 (and partially transmitted through that wax layer 31). A second component 42 includes color picked up by transmission through the wax layer 31 and reflected from wax layer 32 and possibly transmitted through layer 31 again. A third component 44 provides color transmitted through layers 31, 32 and reflected from layer 34 to again be transmitted through layers 32 and 31. Generally components 40, 42, and 44 will be combined into a single highly saturated or color mixed light providing a more vivid, very, or saturated color experience to the user. The sheet 16 may include an opacifier or reflective agents 41 to improve the amount of light returned in components 40, 42 and 44

Figure 4:
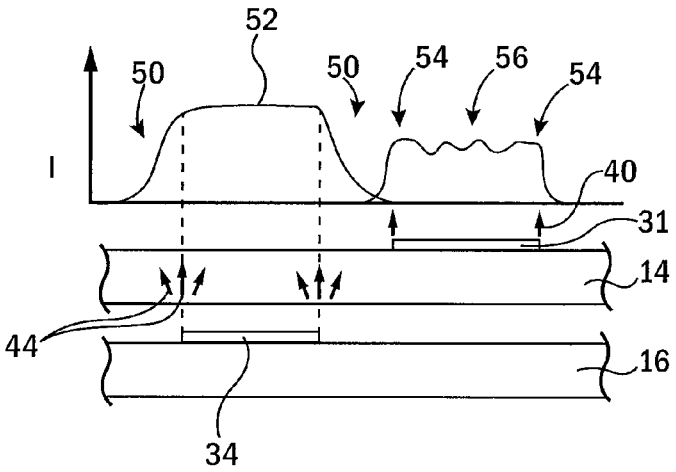
FIG. 4 is a figure similar to that of FIG. 3 showing a diffusing effect on color patterns on the opaque layer versus the semitransparent layer.

Referring now to FIG. 4, the transparent sheet 14 also serves a diffusing function so that light component 44 reflected from layer 34 is diffused to provide for a more smoothly graduated intensity value 50 at edges of the colored region 34 in a more uniform color field 52 within the area of the layer 34. In contrast, color layer 31 provides a light component 40 that is substantially undiffused providing generally sharp intensity drop-offs 54 at edges of the layer 31 and an irregular color field 56 within layer 31 caused by irregularities in the coloring process on a rough surface of the semitransparent sheet 14.

Figure 5:
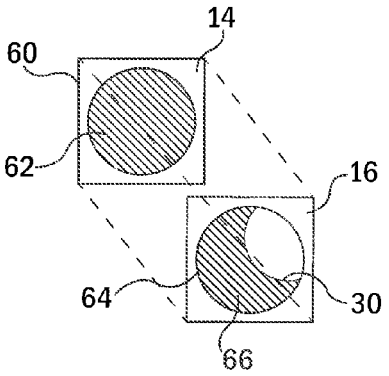
FIG. 5 is a simplified representation of a two layer coloring pattern with a shading layer and a monochrome layer.

Referring now to FIG. 5, color layers 31, 32, and 34 provide augmenting color emitters that may be used in a variety of different techniques. In one technique, an upper transparent sheet 14 provides a uniform color pattern 62 of the type conventionally intended in coloring books with the regions within an outline uniformly colored. This form of coloring is sometimes termed "ligne claire" or "atomic style" refers to a technique with uniform color fields and simple lines that avoid shading or hatch marks. In contrast, a lower pattern 64 provided by layers 34 or 32 may provide for a shading color pattern 66, for example, as implemented by a coloring guidelines 30, whose hard edges will be diffused as described above with respect to FIG. 4 to produce a more realistic shading effect.

Figure 6:
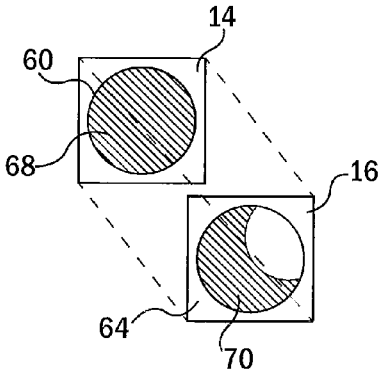
FIG. 6 is a figure similar to that of FIG. 5 showing two monochrome layers for color addition.

Alternatively, as shown in FIG. 6, both the upper layer 60 and lower layer 64 may provide for uniform color patterns 68 and 70 respectively, but the colors used in these uniform color pattern 68 and 70 may be different to provide for unusual effects or hues not readily obtained with the available crayons.

Figure 7:
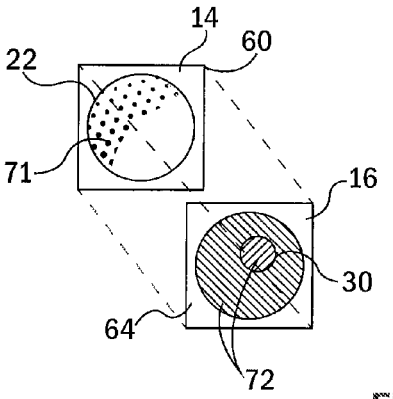
FIG. 7 is a figure similar to that of FIG. 6 showing a coloring pattern with an overlying black shading layer.

Referring to FIG. 7, the upper layer 60 may provide for a black stippling 71 as well as an outline 22 or instead of only an outline 22. The stippling 71 may be dots or artistic stippling such as hatching or the like. The lower layer 64 may provide for multiple color fields 72 providing hues whose intensity is modulated by the black stippling 71. It will be appreciated that the coloring guidelines 30 may alternatively be provided on a separate sheet and used for rough guidance only with the user transferring the color guidelines mentally to the sheet 16 during the coloring process.

Figure 8:
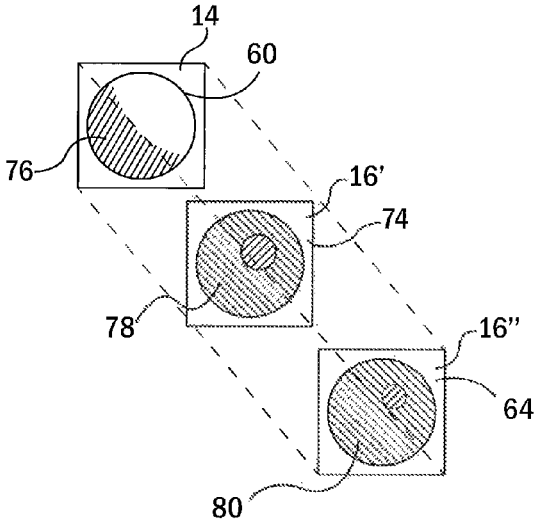
FIG. 8 is a figure similar to that of FIGS. 5-7 showing three layers comprising the opaque layer and front and back of the semitransparent layer each having a different coloring pattern.

Referring to FIG. 8, intermediate layer 74 between upper layer 60 and lower layer 64 (for example provided by layer 32) may be used where each the layers has a different color pattern 76, 78 and 80 (from different coloring guidelines 30) to provide different colors that combine to provide both the range and gradation in shading It will be understood that the registration process of the present invention is not limited to the binding effect of the spine 18 but may also implemented with loose semitransparent sheets 14 and opaque sheets 16 aligned by a picture frame, clips, glue, registered holes, or the like.

Generally the terms translucent and semitransparent are used synonymously herein both indicating inability to transmit light with diffusion in contrast to transparent which transmits light without substantial diffusion.

A crayon coloring system substantially as shown and described employing at least one colorable transparent or translucent sheet having printed guidelines positionable over another colorable layer having printed guidelines.

II. Clock Mechanism

The second invention relates to clock mechanisms for providing an indication of time and in particular to a clock mechanism providing multiple hands and arbitrary rotational rates.

Background of the Invention

Common multi-hand clock mechanisms employ a mechanical timing element (e.g. an escapement driven by a pendulum) controlling a rotating shaft that drive multiple other shafts each attached to different clock hands through a set of gears. By changing the ratio of the gears, a wide variety of different rotational rates may be obtained for the clock hands.

Typical mechanical clock mechanisms require high precision parts and low friction bearings particularly when high gear ratios are employed. These requirements can significantly increase the cost of the mechanism, accentuate problems of mechanism wear, and require sophisticated manufacturing capabilities. Realistic accuracy limitations in the timebase used in most mechanical clocks and the problems of mechanical friction practically limit the ability of such clocks to provide extremely low rotational rate hands (for example, for eclipse prediction).

Summary of the Invention

The present invention provides a clock mechanism that may accurately produce a wide variety of different hand rotational rates with a simple and low precision mechanism. Generally the mechanism employs a set of coaxial "ratchet" wheels. A tray of electrically actuated pawls is reciprocated by a motor and or the like to selectively engage and rotate the ratchet wheels independently under control of a microprocessor.

It is thus a feature of at least one embodiment of the invention to provide a simple, low tolerance mechanism that may flexibly provide a wide range of different hand rotational rates without mechanical modification.

DETAILED DESCRIPTION OF THE PREFERRED EMBODIMENT

Figure 9:
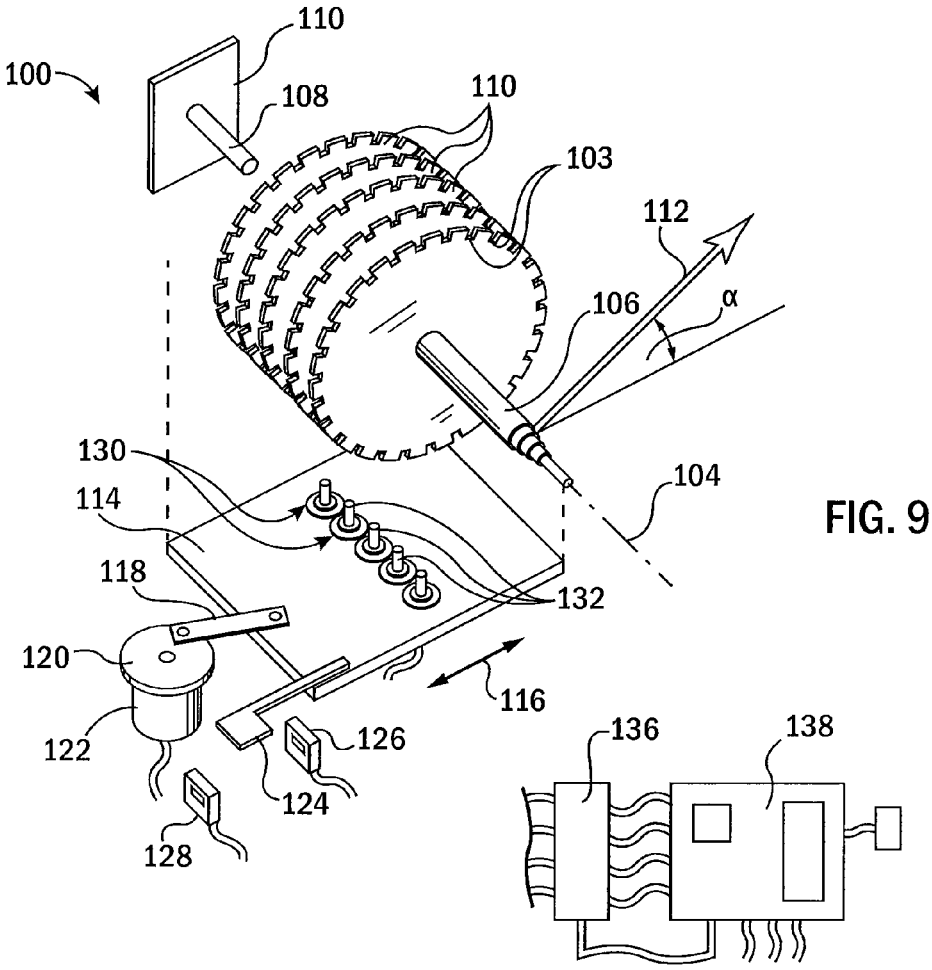
FIG. 9 is a simplified, exploded perspective view of the mechanism of the present invention showing nested clock shafts each attached to a ratchet gear positioned above a corresponding electromechanical pawl held on a carriage that may be reciprocated by a gearmotor.

Referring now to FIG. 9, a clock mechanism 100 of the present invention may provide for a series of ratchet wheels 102 arranged along a common axis 104 to rotate in parallel planes. The ratchet wheels 102 are generally circular discs, for example, approximately ⅛ inch thick having regularly spaced notches 103 extending radially inward from their peripheries by approximately ¼ inch at a regular angular spacing, for example, of 6° center to center.

Each of the ratchet wheels 102 is attached at its center to a tubular shaft 106 extending along the axis 104 there from. The tubular shafts 106 of each successive ratchet wheel 102 is of progressively smaller diameter so that the tubular shafts 106 fit in a telescoping fashion. The tubular shafts 106 are sized to rotate smoothly with respect to each other about a central support shaft 108 extending along axis 104 and attached to a housing 110 or the like. The tubular shafts 106 are of different lengths to extend along axis 104 in a forward direction to expose portions of each shaft 106 edits and removed from the ratchet wheel 102. In this way the ends of the tubular shafts 106 are exposed for separate attachment each to a clock hand 112, the clock hands 112 which may then be rotated independently about axis 104 by angles $\alpha$.

Positioned beneath the ratchet wheels 102 in a direction displaced radially from axis 104 is a sliding tray 114 presenting a planar surface generally parallel to a tangent of the ratchet wheels 102. The sliding tray 114 may be reciprocated as indicated by arrow along an axis 116 perpendicular to axis 104 and aligned with the planar surface of the sliding tray 114. The sliding tray 114 may connect to a crank arm 118 attached to a wheel 120 turned by a gearmotor 122 so that with rotation of the gearmotor the sliding tray 114 reciprocates with the generally sinusoidal motion along axis 116.

The sliding tray 114 may hold a series of electromagnetic pawls 132 being generally pawls of solenoids 130 extending vertically upward from the tray 114 expelled by actuation of the solenoids 130. Each of the pawls 132 is aligned with a plane of rotation of a different ratchet wheel 102.

The sliding tray 114 may support an optical interrupter flag 124 that moves along axis 116 with the sliding tray 114. The position of the optical interrupter flag 124 may be detected at the two extreme positions of reciprocation of the sliding tray 114 by one of two photodetector assemblies 126 and 128 opposed along the reciprocation axis 116 and attached to the housing 110. The photodetector assemblies 126 and 128 may, for example, provide for C-shaped housings supporting in opposition a photodetector and light emitting diode. The optical interrupter flag 124 may trigger the photodetector assembly 126 or 128 by interrupting a beam between the photodetector and light emitting diode of the photodetector assembly 126 or 128. Sensing the limits of excursion of the sliding tray 114 allow the gearmotor 122 to be controlled to effect a single reciprocation during which the electromagnetic pawls 132 may be controlled in time as will be described further below to provide movement of one or more of the ratchet wheels 102.

Generally when the sliding tray 114 is in its extreme rightmost position (per FIG. 10) the gearmotor 122 is deactivated. This rightmost position will be termed the ready position and is the position that the tray 114 resides in between its operation to move the ratchet wheels 102.

Figure 10:
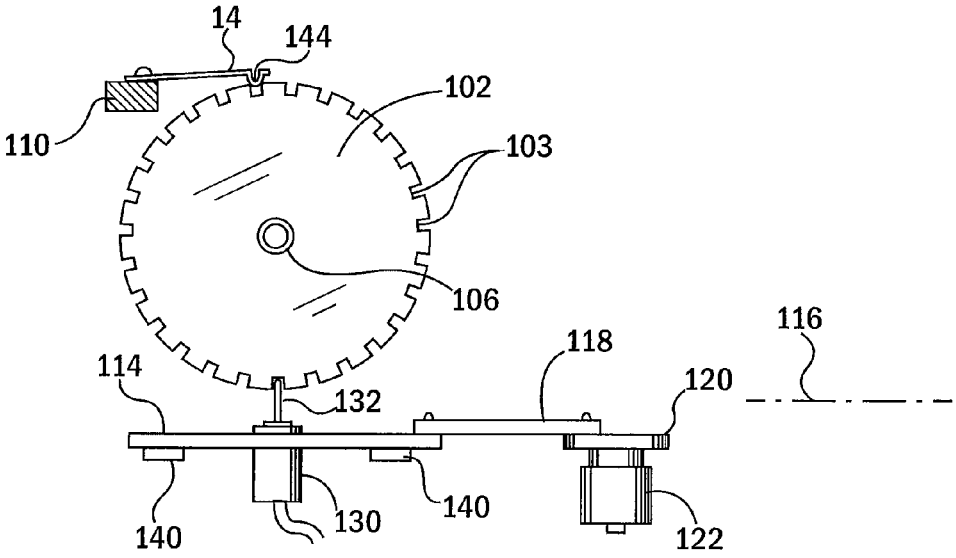
FIG. 10 is a front elevational view of one ratchet gear engaged by an electromechanical pawl.

When one or more ratchet wheels 102 are to be moved, the pawls 132 corresponding to those ratchet wheels 102 are extended (as shown in FIG. 10) by activating their corresponding solenoids 130. The gearmotor 122 is then controlled to produce one half cycle of reciprocation thereby moving the sliding tray 114 fully leftward so that the pawls 132 pull their ratchet wheels 102 along with them is financing the ratchet wheels 102 as will be described below in more detail.

Each of the gearmotor 122, the photodetector assemblies 126 and 128, and the solenoid 130 our attached through an interface board 136 to a microcontroller 138, for example, an Arduino Uno microcontroller (http://www.arduino.cc) based on an Amtel chip and generally available from a number of suppliers. The interface board 136 may provide an interface between low voltage control signals from the microcontroller 138 and high currents necessary to drive the gearmotor 122 and electromagnetic pawls 132 by means of a transistor as will be generally understood in the art. A similar transistor level shifting circuit may be used to interface the photodetector assemblies 126 and 128 to the microcontroller 138. The microcontroller 138 may also connect to a real-time clock such as the DS1307 or DS 3231 to provide accurate time signals necessary for clock.

Referring now to FIG. 10, the sliding tray 114 may be supported on glides 140 to move along axis 116 under action of the gearmotor 122 so that a given pawl 132 may engage a notch 103 of the ratchet wheel 102 when the corresponding solenoid 130 is energized and may be free from interference with rotation of the ratchet wheel 102 when the corresponding solenoid 130 is deenergized. A keeper spring 142 engages notches 103 on each ratchet wheel 102 opposite the pawl 132 to hold the ratchet wheel 102 against inadvertent motion when it is not engaged with a pawl 132. Such motion may, for example, be caused by frictional coupling between a telescoping tubular shaft 106 of a moving ratchet wheel 102 and other stationary ratchet wheels 102 or external shocks or vibration. Generally, the keeper spring 142 provides a rounded tooth 144 at the end of a cantilevered spring arm biasing the rounded tooth 144 radially inwardly at the periphery of the ratchet wheel 102. The keeper spring 142 allows the ratchet wheel 102 to be moved easily in either direction once the spring force of the keeper spring 142 is overcome pressing the tooth 144 out of the notch 103. The spring keeper pawl 142 will engage a notch 103 at regular "neutral" positions with of rotation of the ratchet wheel 102 in alignment with a pawl 132 at the rest position.

Figure 11:
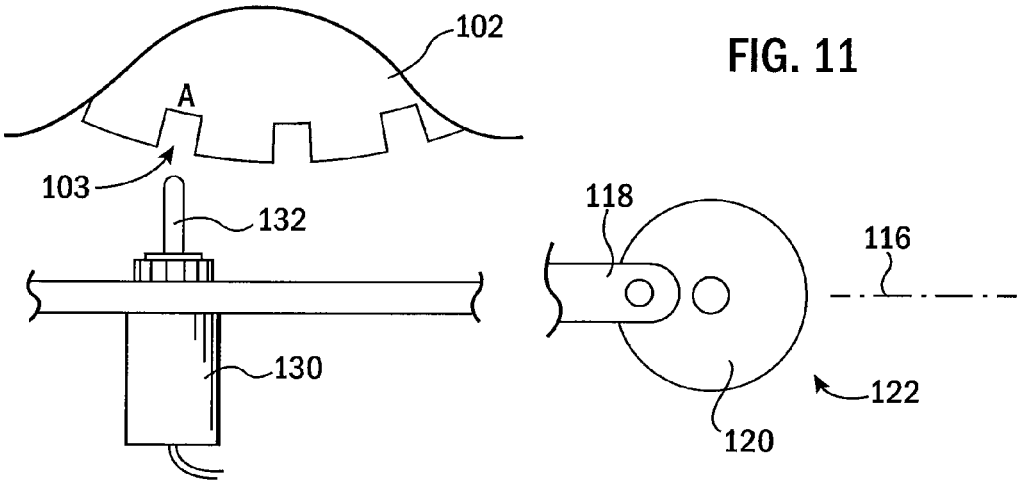
FIG. 11 is a fragmentary view of FIG. 10 and a top view of the gearmotor at a first resting stage in between clock hand movement.

Referring now to FIG. 11, when the ratchet wheel 102 is in a neutral or rest position as described above, and then pawls 132 on the sliding tray 114 are in their "ready" position (the extreme leftmost position in FIG. 11-14 beneath one notch 103 designated "A". At this time, the pawl 132 is down (deenergized) waiting for the next command to move the ratchet wheel 102.

Figure 12:
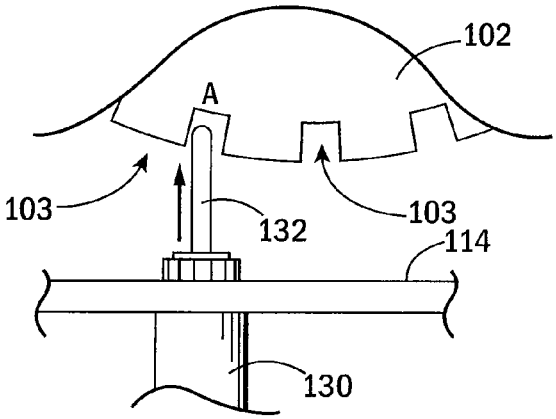
FIG. 12 is a figure similar to that of FIG. 11 showing the electromechanical pawl engaging the ratchet in preparation for clock hand movement.

Referring to FIG. 12, when a command is from the microcontroller 138 (shown in FIG. 9) is received at the gearmotor 122 to move the ratchet wheel 102 by one position (a position being the angular spacing between adjacent notches 103), the appropriate solenoid 130 is activated to extend the pawl 132 associated with the particular ratchet wheel 102 to be moved. The pawl rises to engage the notch 103 designated A.

Figure 13:
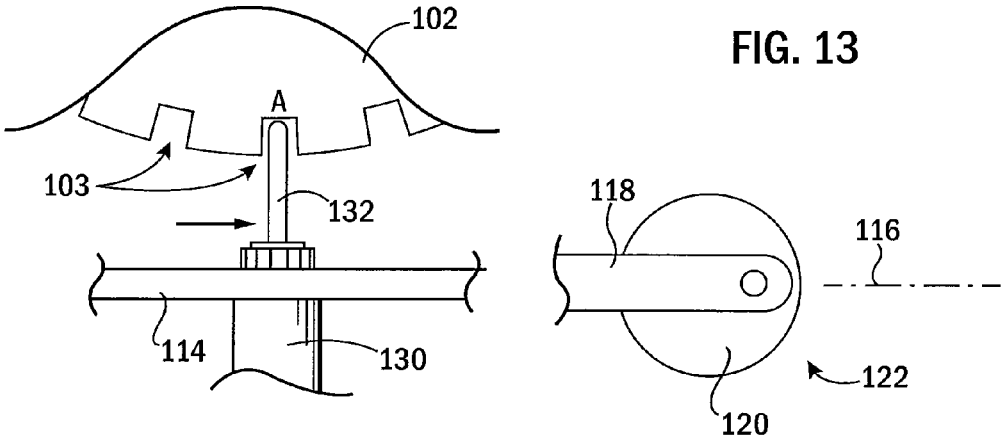
FIG. 13 is a figure similar to that of FIG. 11 showing movement of the gearmotor to draw the electromechanical pawl to an advanced position pulling the ratchet gear one increment.
Figure 14:
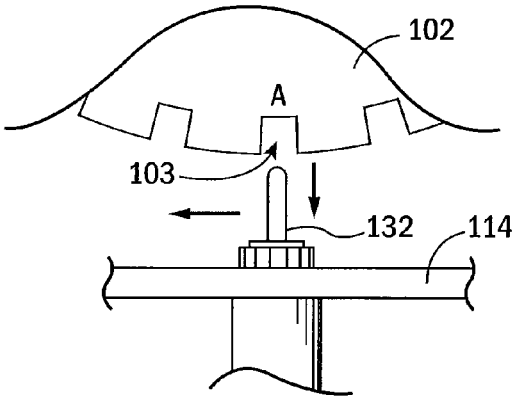
FIG. 14 is a figure similar to that of FIG. 12 showing retraction of the pawl prior to return to the position of FIG. 11.

Referring to FIG. 13, after a short time delay allowing the full extension of the pawl 132, the gearmotor 122 is activated to pull the sliding tray 114 to its extreme rightmost position carrying with it the solenoid 130 and the pawl 132 engaged with notch 103 (A) and thus rotating the ratchet wheel 102 by one inter-notch increment (typically 6°). When the gearmotor 122 has pulled the sliding tray 114 to its extreme rightmost position per the action of wheel 120 and crank arm 118, as detected by optical sensor 126, power is released from the solenoid 130 and the pawl 132 drops down as indicated by FIG. 14 out of engagement with the notch 103 designated A. The gearmotor 122 continues to rotate until it reaches the ready or neutral position indicated by FIG. 11 at which time the gearmotor 122 and solenoid 130 remain in the off condition until a new movement of the ratchet wheel 102 is required.

Generally the microcontroller 138 (shown in FIG. 9), will monitor counts of a real-time clock and when sufficient counts have been accumulated will set bits in a movement buffer. Then on a regular interval (for example determined by the same real-time clock) movements of the tray 114 described above will be initiated with those pawls 132 corresponding to buffers having bits in them being activated. If no buffers have bits in them, the movement of the tray 114 is skipped until the next period. Setting the bits in the buffer may be done by a simple divider to provide an arbitrary "gear ratio" for the particular ratchet wheel 102.

Figure 15:
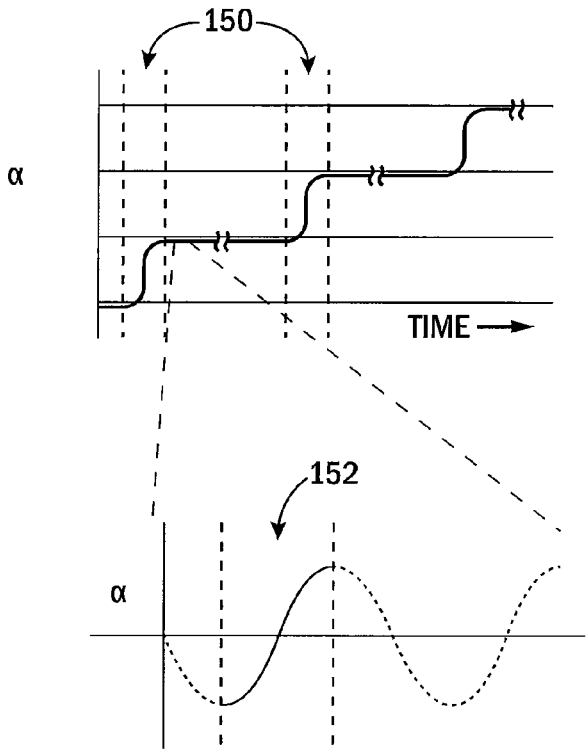
FIG. 15 is a plot of angular position of a ratchet wheel with time during the sequence of FIGS. 11-14 showing the smooth acceleration and deceleration of the ratchet wheel such as permits reduced torsional forces on the clock hands.

Referring to FIG. 15, the angular motion a of a ratchet wheel 102 as a function of time is largely at zero angular velocity during a period between motions of the ratchet wheels 102 which may occur as infrequently as once a minute. When the ratchet wheels 102 are stationary, no power is used by the gearmotor 122 or solenoids 130. Power use is confined to with short transition periods 150, when the ratchet wheels 102 are moved to increment the hands 112 and the solenoids 130 and gearmotor 122 may be activated. The extremely low duty cycle for many clock functions will thus minimize the power usage of the clock.

During the transition periods 150, the motion of the ratchet wheel 102 conforms approximately to a section of the sine wave 152 as a result of the crank arm 118 and wheel 120 connection. Longer crank arms 118 will provide closer conformance to a sine wave. It will be appreciated that a sine wave may be repeatedly differentiated while retaining bounded values (the derivatives of a sine wave being successive sine and cosine waves of various phases). This means that the peak torques experienced by the hands 112 and their attachment to the shaft 106 and is limited as would otherwise require stiffer and stronger components or shorter and lighter hands 112. The bounding of angular derivatives with time fundamentally limits the third derivative of motion (jerk) such as can cause unnecessary wear. For this reason components of the present invention may be largely constructed of simple materials such as wood and plastic without undue wear concerns.

It will be appreciated that the pawl elements may, for example, be any electrically controllable engaging elements including electrically controllable bimetallic elements, wax motors or the like and that the tray 114 may slide linearly or maybe position to rotate about a common axis with the ratchet wheels 102 or other similar compatible motions.

The invention provides a clock mechanism having a set of indexed wheels that may be electronically individually engaged to move during a half cycle of a reciprocating carriage under the control of the electronic computer.

III. Automatic Pendulum Clock Tuner

The third invention relates to clocks using pendulums as a timebase and in particular to a method for automatically tuning and maintaining a high precision for such clocks.

Background of the Invention

Pendulum clocks such as grandfather or grandmother clocks represent a design that was unsurpassed for accuracy up until the development of electronic oscillator based clocks (for example using quartz resonators) in the 1930s. Such clocks rely on the relatively steady period of a swinging pendulum. In the present day, such clocks provide a stately reminder of a simpler time and an attractive example of fine craftsmanship and elegant mechanism. Often such clocks employ mechanical chimes which provide an audible reminder of the passage of time that would be difficult to duplicate in any other way.

Despite the charm of such clocks, considerable care and patience in adjusting the clock is required to obtain an accuracy that is typically lower than one minute per week and for most clocks as much as five or ten minutes of drift during that time. Adjusting the clock requires stopping the pendulum and making physical changes in the length of the pendulum. Normally this process must be repeated over a period of several weeks or a month because determination of the error requires sufficient time for the error to accumulate to be registered by the clock mechanism.

While this degree of accuracy for pendulum clocks is quite good for most purposes, in a modern environment with the ubiquity of high accuracy clocks, an error of several minutes or more, especially with a chiming clock, can be offputting.

Summary of the Invention

The present invention provides a method of adjusting the effective periodic rate of the pendulum without the need to adjust the pendulum weight or length but rather by adjusting the effective gravitational acceleration on the pendulum. A changing gravitational acceleration is simulated by a magnetic attraction between a small permanent magnet and a ferromagnetic material such as an iron plate, each held on opposite ones of the pendulum and the stationary reference point with respect to the movement of the pendulum. By changing the separation between the ferromagnetic material and magnet, the speed of the pendulum may be changed without direct contact to the pendulum.

DETAILED DESCRIPTION OF THE PREFERRED EMBODIMENT

Figure 16:
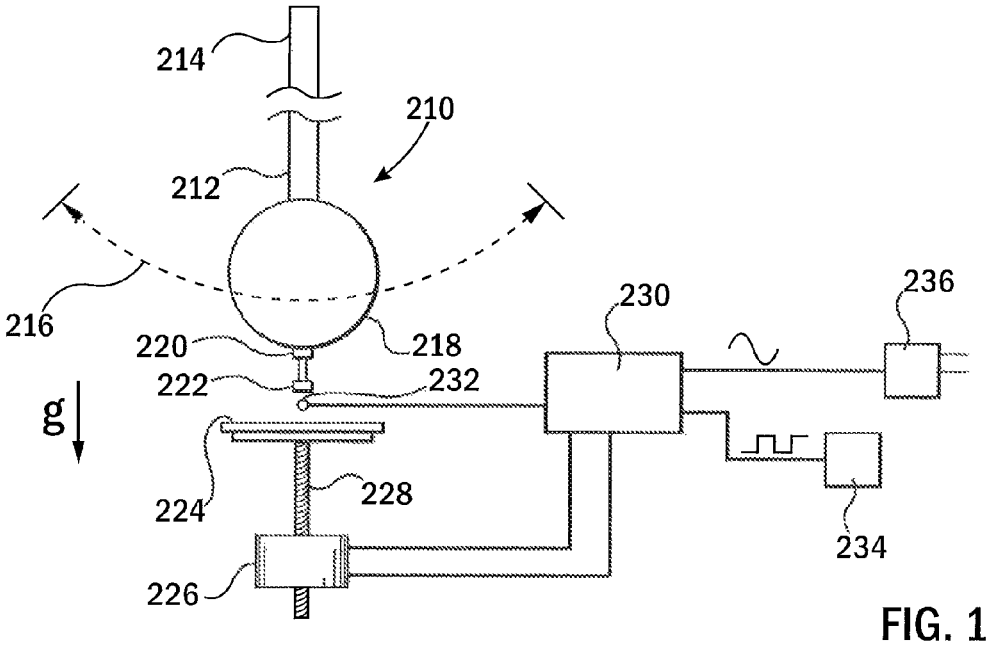
FIG. 16 is a simplified schematic of the present invention showing a pendulum bob at its equilibrium position having a small magnet attached thereto and positioned above a steel plate to which the magnet is attracted, and further showing a control system for controlling the separation between the plate and magnet by means of the stepper motor.

Referring now to FIG. 16, a pendulum 210 may provide for a pendulum arm 212 swinging about a pivot 214. The pivot 214 is directly above a vertically extending pendulum arm 212 when the pendulum arm 212 is in its equilibrium position within an arcuate swing range 216. A pendulum bob 218 may be attached to a lower end of the pendulum arm 212 to provide substantially the dominant mass of the pendulum.

The separation between a center of mass of the pendulum bob 218 and the pivot 214 (the pendulum length) may be controlled by an adjustment nut 220 on a threaded rod extending from the end of the pendulum arm 212. The nut 220 supports the pendulum bob 218 which may otherwise slide along the pendulum arm 212. In this way, the nut 220 may be turned to slightly raise or lower the pendulum bob 218 on the pendulum arm 212 to provide coarse adjustment of the pendulum frequency. The pivot 214 may communicate through an escapement or other well-known mechanism with a clock mechanism (not shown) providing, for example, a gear train connected to hands reading out hours and minutes and to a chiming mechanism for chiming at various intervals. A set of weights or other source of motivating power may attach through the gear mechanism to the pendulum to provide periodic impulse to the pendulum to keep it swinging. Typically this periodic impulse is also provided by the escapement. The period of the pendulum may be approximated by the formula $$T = 2\pi\sqrt{\frac{L}{g}}$$

where T is the time for the pendulum to complete a single cycle, L is the length of the pendulum between the center of mass of the bob 218 and the pivot 214 and g is the acceleration of gravity. As is understood in the art, adjusting the nut 220 changes the length L to change the value of T to bring the clock into a highest state of accuracy.

The present invention provides at an end of the threaded rod extending downward from the nut 220, a small rare earth magnet 222. In addition, a steel plate 224 having a generally horizontal orientation is positioned centered beneath the magnet 222 but spaced therefrom when the bob 218 is in the equilibrium position. A force of magnetic attraction between the magnet 222 and the steel plate 224 through a range of it swinging provides a downward force simulating that of gravity during a portion of the swing range 216. This downward force modifies the period of the pendulum according to the equation:

$$T = 2\pi\sqrt{\frac{L}{g+m}}$$

where m is an integral of the instantaneous magnetic force vector between the rare earth magnet 222 and the steel plate 224 over the arcuate swing range 216 which, because of its symmetry, will generally be a vertically oriented force aligned with the gravitational vector g and represents roughly average force imparted by the attraction of the magnet 222 and the steel plate over the swing range 216. Adjusting the plate 224 upward or downward will increase or decrease the value of m, respectively.

The steel plate 224 is mounted for such vertical movement, for example, on a stepper motor 226 providing a helical drive shaft 228 to which the steel plate 224 is attached so that rotation of the stepper motor extends or retracts the drive shaft 228 and decreases or increases the separation between the steel plate 224 and the magnet 222.

The stepper motor 226 may be controlled by a microcontroller 230 which may further receive a signal from a Hall effect sensor 232 positioned between the magnet 222 and the steel plate 224 and activated by the magnet 222 during some part of the swing of the bob 218 to reveal the actual period of the pendulum. The microcontroller 230 may, for example, be an Arduino Uno as described above. The microcontroller 230 may also receive a timing signal, for example, from a real-time clock 234 (such as the DS 1307 widely available from a number of suppliers) or by monitoring the frequency of wall voltage from an AC power source 36 according to well-known techniques.

The microcontroller 230, being an electronic computer providing some input/output circuits, and a processor communicating with a nonvolatile memory holding a program may execute that program to count the number of pendulum swings as determined by the Hall effect sensor 232 versus a known desired time for those pendulum swings under the assumption that the pendulum 210 is perfectly adjusted to swing at the right rate. For large grandfather clocks, the period of the pendulum 210 will normally swing 60 to 72 times per minute which may be assessed by observation.

When the number of pendulum swings detected by the Hall effect sensor 232 is less than would be required for a perfectly tuned pendulum for a predetermined interval of time, the steel plate 224 is moved up toward the pendulum bob 318 and when the number of pendulum swings is more than would be required for a perfectly tuned pendulum for the predetermined interval of time the steel plate 232 is moved down. This control may implement a proportional feedback loop and it will be understood that increased accuracy may be obtained by also looking at an integral term, for example tallying the total number of pendulum swings and elapsed time and the error between them to effect a second control loop. Extremely fine movements of the steel plate 224 may be obtained for high accuracy of much less than one second per week. The current inventors have obtained time errors of one in less than 10,000 and there appears to be no limit to the accuracy provided the control loop is active. In the event of power outage, friction holds the system in its last state providing the highest degree of static tuning possible.

It will be appreciated that the positions of the ferromagnetic material and magnet may be reversed, that other mechanisms may be used to raise and lower the steel plate such as a cam or lever and that a variety of control algorithms may be used to the same effect. Clearly the motor 226 may be removed in favor of a manual adjustment knob or the like and the magnet and plate system alone without sensor or electronics provides an alternative adjustment mechanism for such clocks that does not require stopping the pendulum.

The invention provides a tuning system for pendulum clocks having an opposed magnet and ferromagnetic attractor positioned between the pendulum and a stationary surface and allowing for controllable separation of the magnet and ferromagnetic attractor to change the period of the pendulum. The separation may be controlled electronically by sensing pendulum swings and comparing them to a precise clock to adjust the separation according to deviations between these two measures.

IV Electronic Musical Instrument Control Surface

The fourth present invention relates to a control surface for an electronic instrument such as a MIDI instrument and in particular to a highly sensitive and versatile control surface for real-time performance.

Background of the Invention

Electronic music synthesis synthesizes the sound of conventional instruments using electronic circuitry that duplicates physically vibrating elements of such instruments with electronic resonators or more recently algorithms or wave tables executed by electronic processors. The earliest controllers for such music synthesizers included keyboards, being arrays of electrical switches. To provide control for loudness as well as pitch of a note, it is known to provide keyboards with velocity sensing, the velocity of the keypress movement between two points being a rough proxy for the force of pressing.

Current controllers may provide an improved loudness control dimension through the use of piezoelectric elements or sensing resistive elements both of which may directly detect finger pressure on an elastomeric pad above the sensor. Such controllers may be used to launch pre-recorded waveforms of drums (using a drum synthesizer, being a type of music synthesizer) with amplitude selected according to the pressure exerted on the elastomeric pad. While a traditional keyboard is arrayed in substantially a linear manner, controllers of this type may be arranged in rows and columns of buttons.

One drawback to current controllers that provide velocity sensing is a latency between pressing the control surface and obtaining the musical note. Some of this latency is the result of a time necessary to determine the peak amplitude of the pressing force or the velocity of the key before the corresponding soundwave form can be output with the proper amplitude. Considerable force may be necessary to activate the key, possibly because there is a need to prevent crosstalk between keys when detecting the force is both a trigger and a loudness control signal.

The controller may provide signals to the music synthesizer to control the latter, those signals typically but not always conforming to the musical instrument device interface (MIDI) standard. The signal may include a pitch, velocity, and possibly other dimensions of control such as pitch bending and the like.

Summary of the Invention

The present invention provides a multi-surface controller for electronic music that differs from conventional controllers in at least one of two respects. First, it provides orthogonal control surfaces that separate the keypad into intuitively distinguishable groupings by orientation that may nevertheless be quickly accessed. Second, it provides extremely sensitive low latency control through the use of capacitive touch switches augmented for the purpose of velocity sensing with an accelerometer. A multiaxis accelerometer allows multiple control surfaces to be simultaneously activated with different accelerations and yet successfully decoded independently.

DETAILED DESCRIPTION OF THE PREFERRED EMBODIMENT

Figure 17:
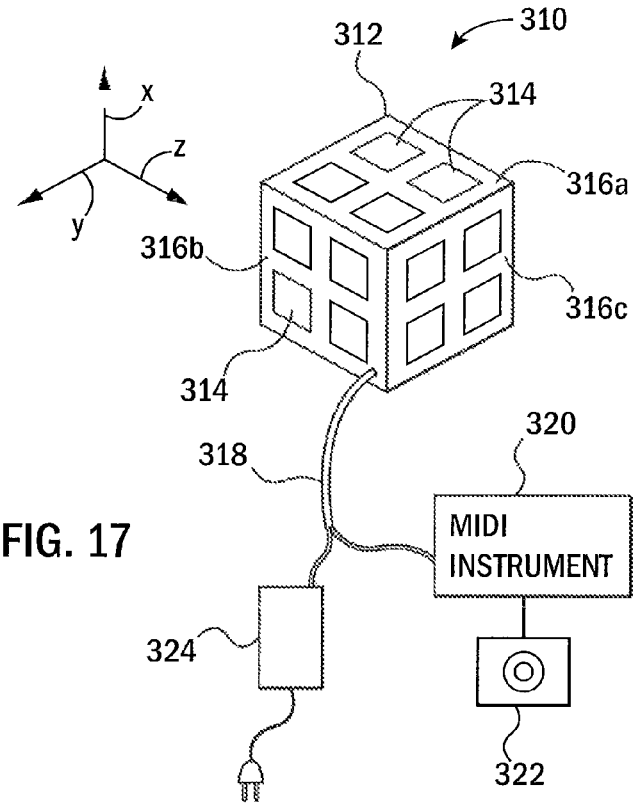
FIG. 17 is a simplified perspective view of the controller of the present invention showing outer conductive pads arranged on a cubic housing.

Referring now to FIG. 17, an electronic instrument controller 310 may provide, for example, a hollow cubic housing 312 constructed of an electrically insulating material and sized to be grasped in one's hand and freely moved. The housing 312 may support an array of conductive touchpads 314 on an upper face 316*a*, a left side face 316*b* and a right side face 316*c* (as shown) or on any two or more perpendicular surfaces. The conductive touchpads 314 may be desirably but not necessarily arranged in two rectilinear rows and columns on the faces 316, for example, with four conductive touchpads 314 on each such face 316. A cable 318 or equivalent wireless connection may communicate with a MIDI instrument 320 that may receive control signals from the controller 310 to provide appropriate sound waveforms to amplifier speaker system 322 as is understood in the art. The cable 318 may also communicate with the power supply 324 for powering the circuitry inside the controller 310 (as will be described) or an equivalent battery-powered power supply ma be inside the housing 312.

Generally, the controller 310 may be played by touching one or more of the conductive touchpads 314 which each act as capacitive sensing switches to trigger the transmission of a MIDI signal to the MIDI instrument 320. The force of touching may be detected by an internal accelerometer (not shown in FIG. 17) providing, for example, three-axis sensitivity along the X, Y and Z axes normal to the face 316*a*, 316*b* and 316*c*, respectively.

Figure 18:
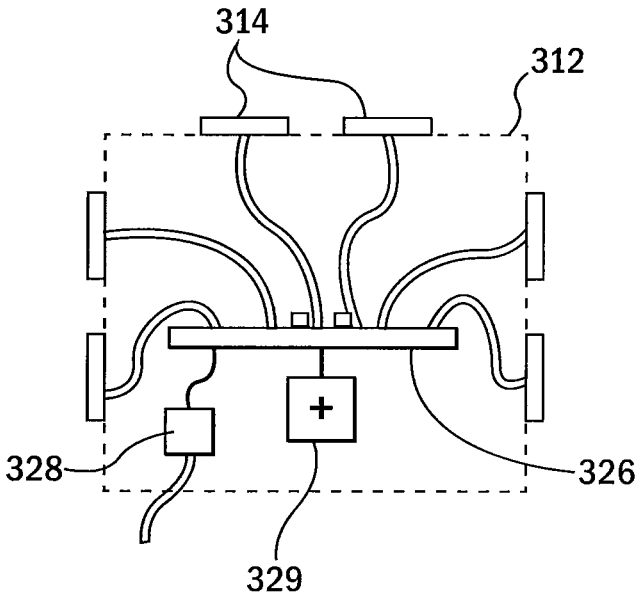
FIG. 18 is a simplified depiction of the interior of the controller of FIG. 17 showing an internal microcontroller communicating with the conductive pads and centrally located accelerometers.

Referring now also to FIG. 18, the housing 312 may contain a microcontroller 326 such as Arduino Due commercially available from a number of suppliers and providing a higher sampling rate to accurately distinguish peak accelerations. The microcontroller 326 may communicate with a three-axis accelerometer 329 (for example the ADXL 345 triple axis accelerometer) communicating with the microcontroller 326 through an I2C interface of a type known in the art to provide readings of accelerator force on the housing 312 along any of the axes X, Y and Z (shown in FIG. 17). Each of these axes will generally be normal to one face 316 allowing orthogonal touchpads 314 among different groups defined by different faces 316.

Output and input pins from the microcontroller 326 may be connected to each of the conductive touchpads 314 and the controller 326 to implement a capacitive touch sensing to rapidly detect touches of those touchpads 314 by capacitive coupling to a human user. The microcontroller 326 may communicate with a MIDI interface circuit 328, for example, including optoisolator and series resistance as defined in the MIDI standard incorporated herein by reference, to forward a MIDI control signal over the cable 318.

Figure 19:
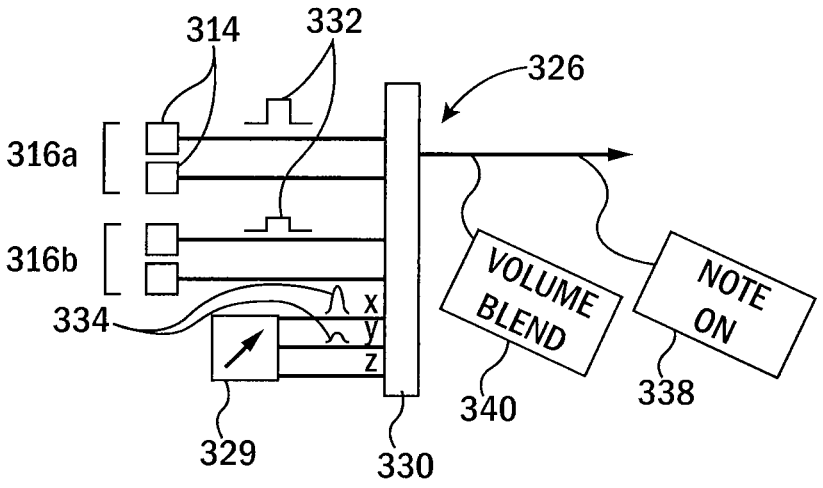
FIG. 19 is a signal flow diagram showing processing of the generated signals by the controller introducing an output to a music synthesizer.

Referring now to FIG. 19, generally the controller 326 will execute a stored program 330 that will detect touch signals 332 on one or more of the touchpads 314 each signal 332 identified to a particular face 316. The program 330 will also receive acceleration signals 334 from one or more of the axes of the accelerometer 329. Upon receiving the touch signals 332, a MIDI output 338 will be generated on cable 318 according to a predefined mapping between touchpads 314 and MIDI instruments and notes. The MIDI output 338 will generally include a note on command, a pitch command and a predetermined velocity command. This may be followed by a second velocity command 340, for example, after a touch or controller command to adjust the volume to a peak value detected in this accelerations signal 334 when that peak occurs significantly after an initial touch. Note that generally simultaneously tapping two faces 316 of the controller will produce a force that may be resolved into X, Y and Z components to be associated with different single touchpads 314 on individual faces 316 because of the orthogonality of the force vectors associated with the faces 316. The clustering of touchpads 314 on the faces 316 provides a memory aid in distinguishing touchpads 314 during play. The touchpads 314 may be grouped in several fashions. For example, each touchpad 314 of a given face 316 may comprise notes of a common chord, or touchpads 314 of each face 316 may provide for different instruments, e.g. percussion, bass, and melody, or each 316 may group touchpads 314 for different functions such as: control buttons, for example, for controlling looping or timing, loop file selection buttons and loop initiation triggering. In contrast to many controllers, the present controller allows the entire controller 310 to move and thus for rhythms to be established, for example, by striking the controller against the surface such as a palm, side of the leg, or moving the controller 310 between two surfaces. The controller 310 may be played with continuous pressing of one or more buttons and a shaking to modulate the loudness.

It will be appreciated that the housing 312 need not be a cube and other shapes providing for orthogonal surfaces may be used. In addition, the dual triggering providing for capacitive sensing augmented by acceleration sensing may be used in a conventional single face controller.

Generally the invention provides an electronic music controller having orthogonal surfaces presenting capacitive touch switches and a contained multiaxis accelerometer operating together to provide two dimensions of musical control.

V. Funnel for Transferring Bottle Contents

The present invention relates to a funnel and in particular to a funnel for recovering and transferring flowable product from partially filled containers into new containers.

Background of the Invention

Product containers for shampoos and soaps and other viscous yet flowable materials can retain anywhere between 3 percent and 25 percent of the product when they are ostensibly empty according to the consulting firm Booz and Company as reported in the Wall Street Journal Wednesday Dec. 12, 2012. This can be the result of pump dip tubes that necessarily do not fully extend to the bottom of the container or general impatience by the consumer in waiting for contained viscous products to flow out of a mostly empty container when that container is inverted. One approach in dealing with this problem is to drain the residual product from an old container into a new nearly full container having a similar product, for example, using a funnel. This can be a time-consuming process requiring the consumer to hold the old bottle in inverted orientation as the product drains over the course of many minutes.

Summary of the Invention

The present invention provides a funnel system for transferring material from an old bottle to a newer bottle that supports the older bottle during the transfer process. This support is practical for a wide variety of different bottle sizes and shapes by means of a central core extending upward from the funnel that supports the old bottle from inside the spout, a dimension that tends to be much more consistent among bottle designs.

DETAILED DESCRIPTION OF THE PREFERRED EMBODIMENT

Figure 20:
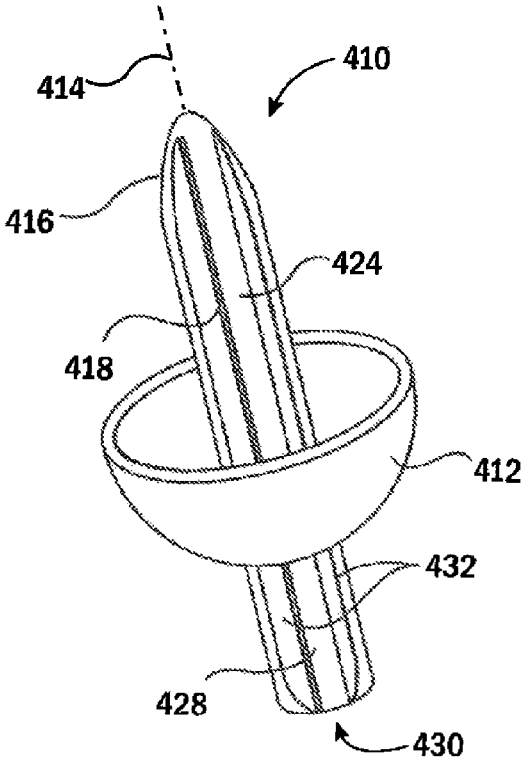
FIG. 20 is a perspective view of the transfer funnel of the present invention.
Figure 21:
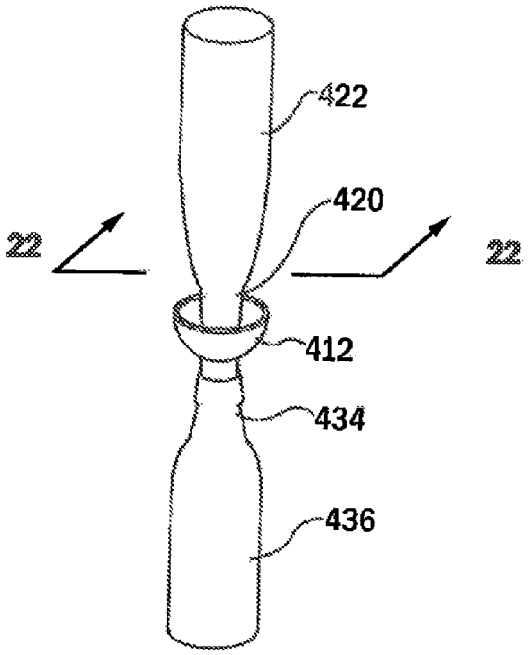
FIG. 21 is a perspective view of two bottles having their contents transferred using the present invention.
Figure 22:
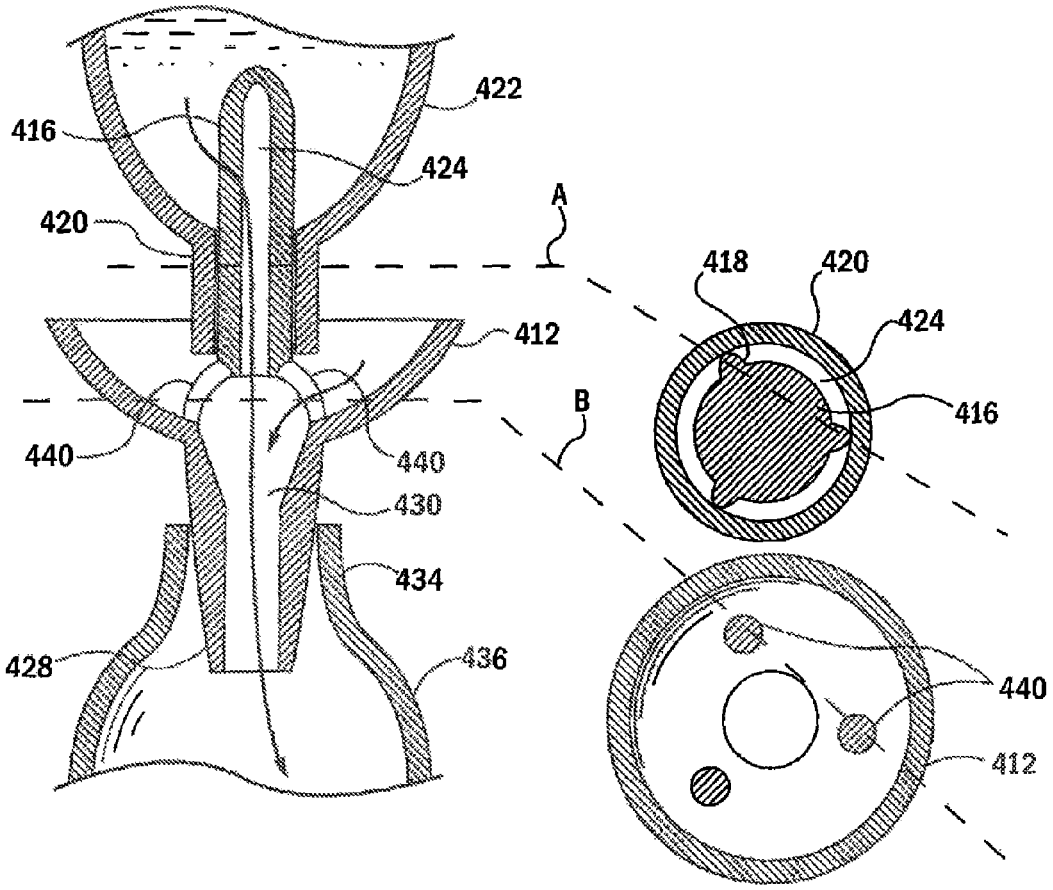
FIG. 22 is a fragmentary cross-section of FIG. 21 taken along line 22-22 positioned near second cross-sections taken along lines A and B of FIG. 22.

Referring now to FIGS. 20 and 21, a transfer funnel 410 of the present invention may provide for an upwardly concave cup 412, for example, providing a hemispherical shell. Extending upward along an axis 414 of the cup 412 is a support column 416 having radially extending ribs 418 running along its length and spaced equally around its circumference. The support column 413 is sized to be received within the neck 420 of a spent bottle 422 of a material such as a lotion or other viscous flowable liquid. The support column 416 may taper inward as one moves upward over its length and the ribs 418 may be molded of elastomeric material so as to flexibly engage a range of inner diameters of bottle necks 420 determined by the present inventors to differ relatively little compared with other dimensions and shapes of the bottles 422. The ribs 418 further prevent an obstruction of the neck 420 by the support column 416 by providing a flow passageway 424 between the ribs out of the neck 420 into the cup 412.

Extending downward from the concave cup 412 from its lower apex is a tubular spout 428 having a central bore 430 open downward and communicating with the interior of the cup 412 in the manner of a funnel. The spout 428 may also have ribs 432 and be tapered so as to support itself against the interior diameter of a neck 434 of the second bottle 436. In this manner the second bottle 436 may support the first bottle 422 in inverted orientation through the inter-fitting of the spout 428 with the neck 434 and the support column 416 with the neck 420.

Referring now to FIG. 23, when so supported, the lower edge of the neck 420 of the upper bottle 422 may rest on spacer legs 440 joining a bottom of the support column 416 with the cup 412. The legs 440 elevate the neck 420 above the bottom of the cup 412 allowing flow through the passageway 424 to accumulate within the volume of the cup 412 without the need for a close seal between bottles 422 and 436. The legs 440 surround the opening 430 of the spout so that material from the cup 412 may freely drain through the opening 430 into the bottle 436.

Generally the invention provides transfer elements for bottles providing a funnel having a spout supporting the funnel within the neck of a first bottle and an upwardly extending support column supporting the neck of an inverted bottle over the funnel.

For all of these inventions, certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

The invention claimed is:

1. A musical instrument comprising:

an electrically insulating housing adapted to be grasped in a human hand and freely moved;

a set of conductive touchpads arrayed on an outer surface of the housing to be touched;

an accelerometer attached to the housing and providing an electrical signal proportional to acceleration of the housing; and an electronic circuit communicating with the conductive touchpads and the accelerometer to detect touching of a given touchpad and in response to the touching of the given touchpad, outputting an electrical signal identifying a musical note having a pitch determined by an identity of the given touchpad and a volume determined by a signal from the accelerometer at a time contemporaneous with touching of the given touchpad wherein the housing includes at least two perpendicular surfaces and wherein at least some of the conductive touchpads are placed on different of the two perpendicular surfaces; and wherein the accelerometer is a multiaxis accelerometer having sensitivity along normals to the to perpendicular surfaces and wherein the outputting of an electrical signal identifies a volume of the musical note by a signal from the accelerometer corresponding to an axis normal to a one of the two perpendicular surfaces on which the given touchpad is placed.

2. The musical instrument of claim 1 further including an electronic music synthesizer receiving the electrical signal and providing an electrical representation of a note of the electrical signal for outputting through an amplifier speaker system as an audible note at a volume dependent on the electrical signal.

3. The musical instrument of claim 1 wherein the electrical signal is a MIDI electrical signal.

4. The musical instrument of claim 1 wherein the two perpendicular surfaces are substantially planar.

5. The musical instrument of claim 1 wherein the touchpads are arranged in rows and columns on at least one of the surfaces.

6. The musical instrument of claim 1 wherein the housing includes at least three orthogonal surfaces and different conductive touchpads are placed on the three orthogonal surfaces.

7. A musical instrument comprising:

an electrically insulating housing adapted to be grasped in a human hand and freely moved;

a set of conductive touchpads arrayed on an outer surface of the housing to be touched;

an accelerometer attached to the housing and providing an electrical signal proportional to acceleration of the housing; and an electronic circuit communicating with the conductive touchpads and the accelerometer to detect touching of a given touchpad and in response to the touching of the given touchpad, outputting an electrical signal identifying a musical note having a pitch determined by an identity of the given touchpad and a volume determined by a signal from the accelerometer at a time contemporaneous with touching of the given touchpad;

wherein the housing includes at least two perpendicular surfaces and wherein at least some of the conductive touchpads are placed on different of the two perpendicular surfaces;

wherein the housing includes at least three orthogonal surfaces and different conductive touchpads are placed on the three orthogonal surfaces; and wherein the accelerometer provides for three axis sensitivity along orthogonal X, Y and Z axes and wherein outputting of the electrical signal identifies a volume of the musical note by signal from the accelerometer corresponding to an axis normal to one of the three orthogonal surfaces on which the given touchpad is placed.

8. The musical instrument of claim 1 wherein the housing a rectangular parallelepiped.

9. The musical instrument of claim 8 wherein the housing is a cube.

10. The musical instrument of claim 1 wherein the electrical signal further identifies a particular musical instrument among a range of multiple musical instruments.

11. The musical instrument of claim 10 wherein the conductive touchpads are arrayed over three dimensions and wherein a given instrument is associated with touchpads sharing a value of one of the dimensions.

* * * * *